United States Patent [19]

Lehtinen

[11] 3,992,254

[45] Nov. 16, 1976

[54] STRUCTURE FOR SEPARATING A WEB AND WIRE IN A PAPER MACHINE

[75] Inventor: Antti Lehtinen, Jyvaskyla, Finland

[73] Assignee: Valmet Oy, Helsinki, Finland

[22] Filed: Jan. 7, 1975

[21] Appl. No.: 539,252

[30] Foreign Application Priority Data

Jan. 8, 1974 Finland ..... 51/74

[52] U.S. Cl. ..... 162/300; 162/301; 162/306; 162/307

[51] Int. Cl.[2] ..... D21F 2/00

[58] Field of Search ..... 162/203, 207, 208, 209, 162/290, 301, 306, 307, 308, 300

[56] References Cited

UNITED STATES PATENTS

| | | | |
|---|---|---|---|
| 2,730,933 | 1/1956 | Reynolds | 162/307 X |
| 3,537,955 | 11/1970 | Huerta et al. | 162/306 |
| 3,821,068 | 6/1974 | Shaw | 162/207 X |
| 3,838,000 | 9/1974 | Urbas | 162/207 |

*Primary Examiner*—S. Leon Bashore
*Assistant Examiner*—Richard V. Fisher
*Attorney, Agent, or Firm*—Steinberg and Blake

[57] ABSTRACT

Structure for facilitating separation of a web and wire in a paper machine. Steam is supplied to the wire at the separating location where the web and wire separate from each other at a side of the wire opposite from the side where the web forms so as to facilitate separation of the web and wire from each other. Steam is supplied from the interior of a container which has a foraminous wall directly engaging the wire so that through the pores of the foraminous wall the steam will discharge to be conducted to the wire. The structure is particularly suitable in connection with twin-wire formers as well as in connection with the manufacture of tissue paper.

4 Claims, 2 Drawing Figures

STRUCTURE FOR SEPARATING A WEB AND WIRE IN A PAPER MACHINE

BACKGROUND OF THE INVENTION

The present invention relates to paper machines and in particular to a structure for separating a web and wire from each other in the wire section of a paper machine.

Particularly in connection with modern twin-wire web-forming machines, difficulties have been encountered in detaching one of the two wires from the web without causing disruption of the latter. Similar problems have been encountered in connection with machines which manufacture tissue paper when it is attempted to separate the web of comparatively low strength from the forming wire so that the web can then be conducted into the press and drying sections.

SUMMARY OF THE INVENTION

It is accordingly a primary object of the present invention to provide a structure which will avoid the above drawbacks.

In particular, it is an object of the present invention to provide a structure which will facilitate separation of the web from one of the wires of a twin-wire former in such a way that the web will not be disrupted.

Also, in connection with a tissue-paper web, it is an object of the invention to provide a structure which will facilitate separation of such a comparatively low-strength web from the wire while being transferred to a pick-up felt.

In accordance with the present invention steam is conducted by way of a suitable steam-supply means so as to impinge on the wire at the separating location where the web and wire separate from each other to travel respectively along different paths beyond the separating location, the steam-supply means preferably including a hollow container which is situated at the separating location.

In the case of a twin-wire machine, detachment of the wire which is first separated from the web (usually the top wire) is brought about in accordance with the invention by conducting steam against the top wire from the interior of a hollow container placed just above the top wire at the separating location, this steam-supply means being situated just before the return roll of the top wire loop around which the top wire travels to return to the region of the headbox.

In connection with a tissue-paper machine, the steam is supplied from a suitable steam-supply means against the wire by way of a hollow container which is situated at the separating location with the web transferring from the wire to a pick-up felt which is urged against the web at the separating location by a separation foil.

With the present invention steam which traverses the wire so as to be received therein creates small bubbles in the water film which is situated against the wire as well as in the mesh of the wire and in the stock web, so that in this way fiber flocs, which form part of the web, are pushed out of the holes or meshes of the wire. These bubbles rapidly condense under the influence of the relatively cold, flowing water film, inducing in this way an implosion effect. As a result, pressure pulses are created to act on the wire and on the web so as to contribute to detaching of the web from the wire without disruption of the web.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
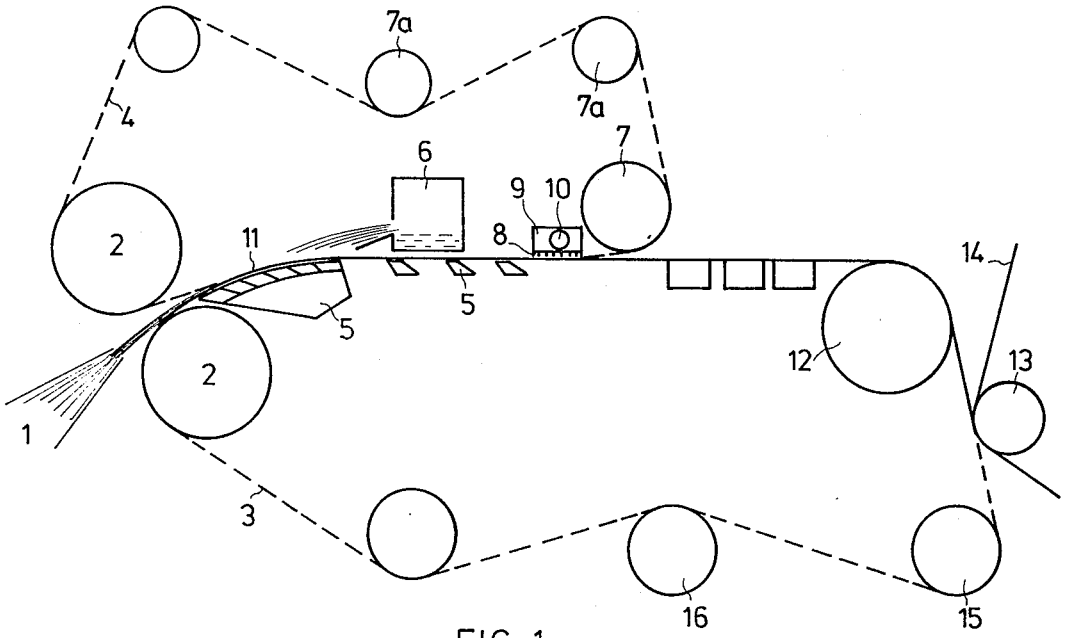
FIG. 1 is a schematic illustration of a structure of the invention as applied to a twin-wire machine illustrated schematically in FIG. 1 in elevation.

Referring now to FIG. 1, in the illustrated twin-wire paper machine the pulp stock is delivered from a headbox through the schematically illustrated nozzle 1 into the throat defined between the breast rolls 2, this throat being defined by the bottom wire 3 and the top wire 4 at the location where these wires are guided around the breast rolls 2. The web 11 which is formed in a known way between the wires is dewatered by way of known dewatering means which include a forming table and foils which are collectively indicated by the schematically illustrated structure 5. Over the lower run of the top wire 4, which forms an endless wire means, there is a schematically illustrated saveall box 6. This lower run of the endless wire means 4 travels to a return roll 7 around which the top wire is guided so as to reach the further rolls 7a which serve to guide the top wire 4, after its detachment from the web 11, back to the upper breast roll 2.

Thus, just before the endless wire means 4 reaches the return roll 7 the wire means 4 and web 11 are separated from each other at a separating location which is situated just ahead of the return roll 7. At this separating location, where the web 11 and the endless wire means 4 separate from each other so as to travel respectively along different paths beyond the separting location, there is, in accordance with the invention, a steam-supply means 9 for conducting steam to the wire 4 at the side thereof opposite from the web 11. The steam-supply means 9 in the illustrated example takes the form of a hollow container to the interior of which the steam is supplied by a pipe 10 which in turn communicates with the steam from any desired source. The container which forms the steam-supply means 9 not only has a hollow interior in which is located the steam which is delivered to the wire, but in addition this container has in engagement with the wire, at the side thereof opposite from the web, a foraminous wall 8 which is of sufficient porosity to have small holes through which the steam discharges to be conducted to the wire, and this wall 8 is urged against the wire 4. The wall 8 may appropriately be made of a sintered material to provide the wall with the required openings through which the steam discharges.

Thus, the steam is supplied so as to impinge on the top wire 4, forming small bubbles in the water film which is on the wire as well as in the meshes of the wire. These bubbles condense with a rapid implosion and with an attendant effect which promotes the separation of the wire and web from each other, as described above. At the separating location the web 11 continues to travel beyond the wire 4 while supported by the bottom wire 3, the web and the bottom wire 3 travelling over the suction roll 12 and up to the point where the web reaches the pick-up felt 14 which laps the pick-up roll 13. At this latter location where the web encounters the pick-up felt 14 the web transfers on to the pick-up felt and continues to travel with the felt while the bottom wire 3 is guided around the traction roll 15 and the guide roll 16 to return to the lower breast roll 2.

Figure 2:
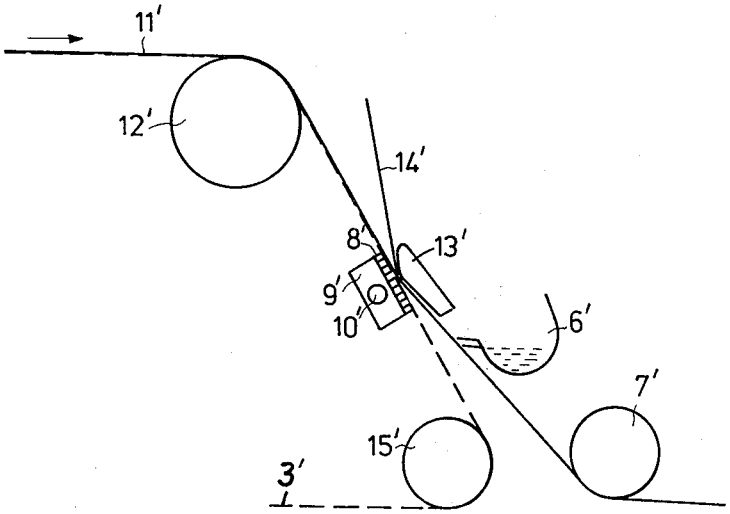
FIG. 2 shows schematically and in elevation the wire section of a single-wire paper machine used for the manufacture of tissue paper and including features of the present invention.

The machine fragmentarily and schematically illustrated in FIG. 2 may be used in connection with the manufacture of tissue paper. In this case the web 11' travels while supported by the wire 3' over the suction roll 12' and together with the wire 3' up to the separating location where the web 11' transfers to the pick-up felt 14' which is guided by the separating foil 13'. At the location where the pick-up felt is urged against the web 11', the steam-supply means 9' has been placed at the side of the wire 3' opposite from the web with the wall 8' of the steam-supply means extending in the manner illustrated through at least a short distance before and after the precise point where separation occurs. The steam-supply means 9' is, as described above in connection with FIG. 1, in the form of a hollow container receiving in its interior steam from the pipe 10' with the container 9' having the sintered wall 8' which forms the foraminious structure through which the steam discharges to be conducted to the wire. Thus, the steam reaching the interior of the container 9' from the pipe 10' discharges in the form of a jet against the wire 3'. As described above, an implosion phenomenon occurs with the result that the transfer of the web to the pick-up felt is facilitated. Beneath the separation foil 13' shown in FIG. 2 there is a saveall 6' which collects water separated from the pick-up felt. After the web 11' has transferred to the pick-up felt, the web together with the pick-up felt travel to the guide roll 7' shown at the lower right of FIG. 2, while the wire 3', which forms the endless wire means of the embodiment of FIG. 2, returns by way of the traction roll 15' and additional guide rolls to the initial or starting end of the wire section.

What is claimed is:

1. In a paper machine, endless wire means on one side of which a web is formed while travelling with said wire means to a separating location where said web and wire means separate from each other and respectively travel beyond said location along different paths, and steam-supply means situated at said location at the side of said wire means opposite from said one side thereof where said web is formed, in close proximity to said opposite side of said wire means for supplying steam to a liquid film at said wire means at said location, said steam-supply means including means for creating in the liquid film steam bubbles which rapidly condense and implode for facilitating separation of the web and wire means from each other, said steam-supply means including a container for containing in its interior steam to be supplied to said wire means, said container having in engagement with said wire means at said opposite side thereof and at said location a foraminous wall through which steam flows from the interior of said container to said wire, said foraminous wall forming said means for creating said steam bubbles.

2. The combination of claim 1 and wherein said foraminous wall is made of a sintered material.

3. The combination of claim 1 and wherein a twin-wire former has top and bottom wires between which the web is formed, said wire means forming said top wire of said twin-wire former.

4. The combination of claim 1 and wherein the web which is formed on said endless wire means is a tissue paper web, a pick-up felt engaging said web at said separating location and a separation foil guiding said pick-up felt into engagement with the web and guiding the pick-up felt and the web which has separated from said endless wire means away from the latter, said steam-supply means being situated at said location and engaging said endless wire means at said opposite side thereof at least through a short distance before and beyond the point where the endless wire means and web separated from each other.

* * * * *